United States Patent [19]

Haas

[11] Patent Number: 4,519,810

[45] Date of Patent: May 28, 1985

[54] CIRCULATION LOOP FOR CARRYING OUT TWO-STAGE REACTIONS

[75] Inventor: John C. Haas, El Sobrante, Calif.

[73] Assignee: Chevron Research Company, San Francisco, Calif.

[21] Appl. No.: 505,529

[22] Filed: Jun. 17, 1983

[51] Int. Cl.[3] ..... C10J 3/54

[52] U.S. Cl. ..... 48/202; 48/210; 406/89; 406/142

[58] Field of Search ..... 48/197 R, 202, 206, 48/210; 406/89, 138, 142, 143, 146; 423/659, DIG. 16; 422/142, 141, 145, 147; 201/31; 34/10

[56] References Cited

U.S. PATENT DOCUMENTS

| | | | |
|---|---|---|---|
| 2,741,549 | 4/1956 | Russell | 48/206 |
| 4,157,245 | 6/1979 | Mitchell et al. | 48/202 |
| 4,421,603 | 12/1983 | Hall | 201/31 |

FOREIGN PATENT DOCUMENTS

| | | | |
|---|---|---|---|
| 537712 | 5/1955 | Belgium | 406/138 |
| 44452 | 3/1980 | Japan | 406/138 |

*Primary Examiner*—Peter Kratz

*Attorney, Agent, or Firm*—S. R. LaPaglia; W. K. Turner; E. A. Schaal

[57] ABSTRACT

A method of controlling the solids circulation between a downflow reactor and an entrained bed reactor is disclosed wherein at least some of the solids are transferred from the downflow reactor to a crossflow fluidized bed through a first seal leg, wherein the crossflow fluidized bed has a baffle separating the crossflow fluidized bed into two zones. Then the solids are transferred from the crossflow fluidized bed to the entrained bed reactor, and the solids are transferred from the entrained bed reactor to the downflow reactor through a second seal leg. The solids circulation rate is controlled by adjusting the rate of fluidizing gas entering the crossflow fluidized bed.

12 Claims, 1 Drawing Figure

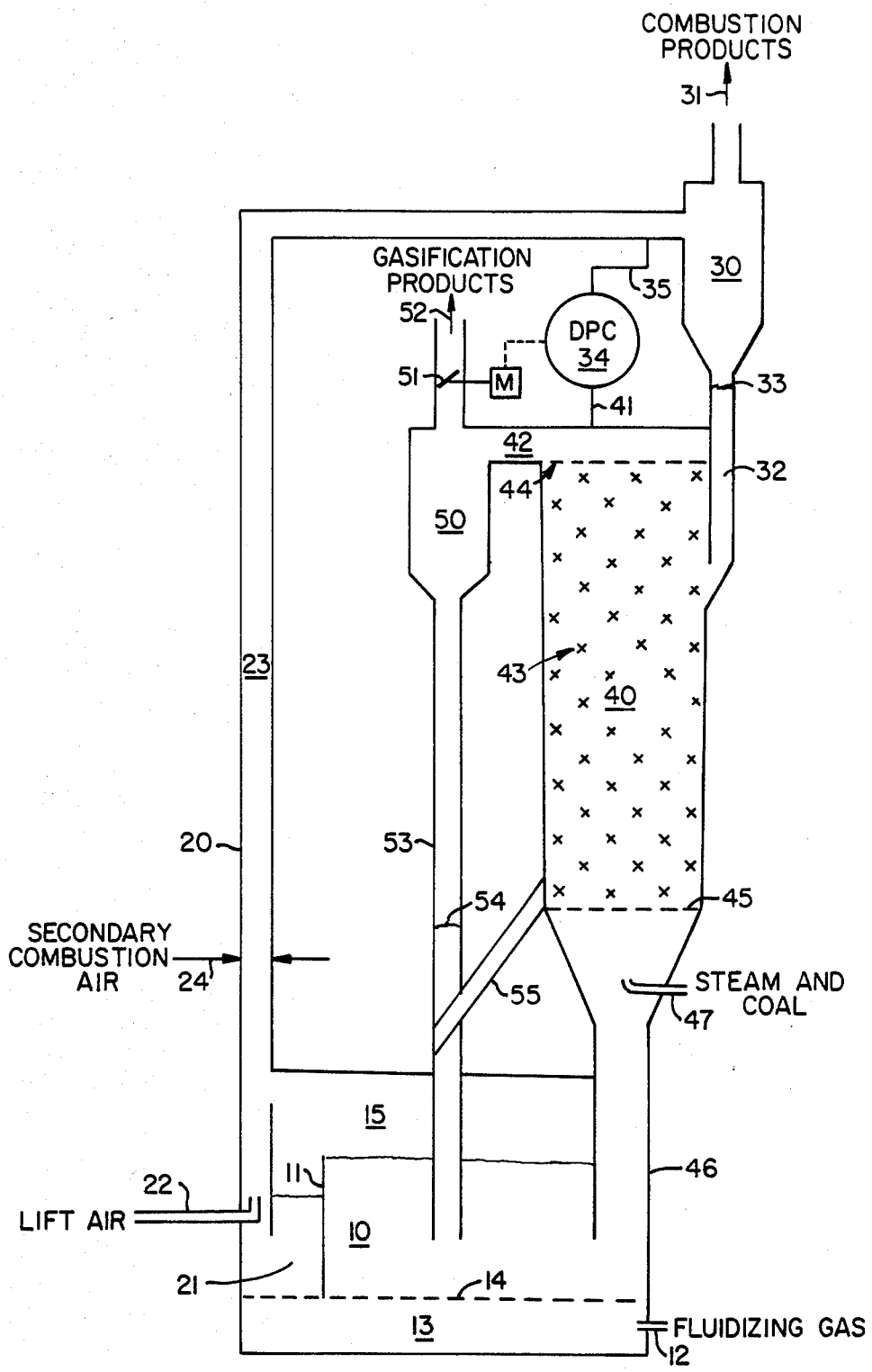
COMBUSTION PRODUCTS
31
30
GASIFICATION PRODUCTS
52
35
DPC 34
51
M
33
41
42
44
32
50
23
43
40
20
53
54
45
SECONDARY COMBUSTION AIR
24
55
STEAM AND COAL
47
15
46
22
11
LIFT AIR
10
21
14
13
FLUIDIZING GAS
12

CIRCULATION LOOP FOR CARRYING OUT TWO-STAGE REACTIONS

BACKGROUND OF THE INVENTION

The present invention involves a method of controlling the solids circulation between a downflow reactor and an entrained bed reactor.

In view of recent increases in the price of crude oil, researchers have been searching for alternative sources of energy and hydrocarbons. Much research has focused on recovering the hydrocarbons from hydrocarbon-containing solids such as shale, tar sand or coal by heating or pyrolysis to boil off or liquefy the hydrocarbons trapped in the solid or by reacting the solid with steam, for example, to convert components of solid carbonaceous material into more readily usable gaseous and liquid hydrocarbons. Other known processes involve combustion of the solid carbonaceous materials with an oxygen-containing gas to generate heat. Such processes conventionally employ a treatment zone, e.g., a reaction vessel, in which the solid is heated or reacted.

In a typical coal gasification process, coal is contacted with steam and an oxygen-containing gas to produce a gaseous product.

When air is used as the oxygen-containing gas, the gaseous product contains high levels of nitrogen, which reduces the BTU content of the gaseous product. Some processes have used pure oxygen instead of air, in order to avoid having nitrogen in the gaseous product. This does eliminate the nitrogen from the product but it requires a source of pure oxygen, some oxygen plants are almost as large as the coal gasification plant they are supplying. Thus, one was faced with the alternatives of either producing a gaseous product diluted with nitrogen or finding a source of pure oxygen for their process.

Another solution to the nitrogen dilution problem is disclosed in U.S. Pat. No. 4,157,245. In one embodiment of the invention disclosed in that patent, a solid heat-transfer material, such as sand, is introduced into an upper portion of a reaction vessel and coal is introduced into a lower portion of the vessel. The physical characteristics of the heat-transfer material and the coal differ such that a superficial velocity of a fluid flowing upwardly through the vessel is greater than the minimum fluidizing velocity of the heat-transfer material and the terminal velocity of the coal, but is less than the terminal velocity of the heat-transfer material. A substantially countercurrent vertical flow of the two solids is maintained in the vessel without substantial top-to-bottom backmixing by passing steam upwardly through the vessel at a rate sufficient to fluidize the heat-transfer material and entrain the coal whereby the heat-transfer material substantially flows downwardly in a fluidized state through the vessel and the coal substantially flows upwardly in an entrained state through the vessel. The steam reacts with the coal to form a hot char and a gaseous product. The heat-transfer material acts as a source of heat for the reaction between the steam and the coal. Cooled heat-transfer material is removed from a lower end of the vessel and the hot char and the gaseous product are removed from an upper end of the vessel. The gaseous product is then separated from the hot char by regular separation techniques.

In one method, the heat-transfer material can be heated by introducing it into an upper portion of a combustion zone, introducing the hot char into a lower portion of the zone, and contacting the heat-transfer material with the hot char while maintaining substantially countercurrent plug flow of the two solids by passing air upwardly through the combustion zone at a rate sufficient to fluidize the heat-transfer material and entrain the char. The heat-transfer material substantially flows downwardly through the combustion zone in a fluidized state and is heated while the char substantially flows upwardly through the combustion zone in an entrained state and is combusted.

The process in U.S. Pat. No. 4,157,245 is based in part on the discovery that in the typical coal gasification process, there are two separate reactions occurring in the same vessel: (1) an endothermic reaction between the coal and steam which produces the gaseous product, and (2) an exothermic reaction between the coal and the oxygen-containing gas which produces the heat necessary for the first reaction. The process of U.S. Pat. No. 4,157,245 separates these two reactions in two separate vessels and transfers the heat generated by the second reaction to the site of the first reaction via a heat-transfer material.

A major advantage of this process is that air can be used as the oxidizing gas without causing the resulting gaseous product to be diluted with nitrogen.

A major disadvantage of this process is that the sand rates must be carefully balanced in various sections of the circulation loop, otherwise the system breaks down.

SUMMARY OF THE INVENTION

The present invention pertains to an improved method of controlling the circulation of a moving burden between a downflow reactor used for endothermic reactions, such as coal gasification, and a fluidized bed-/entrained transport combination reactor used for exothermic reactions such as char combustion. No mechanical valves or L valves are used to control the circulation rate of solids or to isolate gas streams.

In its broadest aspect, some solids are transferred from a downflow reactor to a crossflow fluidized bed through a first seal leg, wherein the crossflow fluidized bed has a baffle separating the crossflow fluidized bed into two zones, then the solids are transferred from the crossflow fluidized bed to the entrained bed reactor and the solids are transferred from the entrained bed reactor to the downflow reactor through a second seal leg. The solids circulation rate is controlled by adjusting the rate of fluidizing gas entering the crossflow fluidized bed.

In one embodiment, coal is gasified in a downflow reactor, which contains internals, to form char and gasification products. Sand is transferred from the downflow reactor to a crossflow fluidized bed through the first seal leg, wherein the first seal leg connects the downflow reactor and the crossflow fluidized bed. This crossflow fluidized bed has a baffle separating the crossflow fluidized bed into two zones. The char and gasification products are passed from the downflow reactor to a first cyclone which separates the gasification products from the char, and a portion of the char flows through a third seal leg into the crossflow fluidized bed. Some of the char is recycled from the first cyclone to the downflow reactor. The sand and char are transferred from the crossflow fluidized bed to an entrained bed reactor, where the char is combusted with air to form combustion products. This air may be added to the entrained bed reactor in stages. The combustion products are separated from the sand by a second cyclone. The pressure difference between the second cyclone and the downflow reactor is maintained by a differential pressure controller. The sand is transferred from the entrained bed reactor to the downflow reactor through the second seal leg. The solids circulation rate is controlled by adjusting the rate of fluidizing gas entering the crossflow fluidized bed.

BRIEF DESCRIPTION OF THE DRAWING

In order to facilitate the understanding of this invention, reference will now be made to the appended drawing. The drawing should not be construed as limiting the invention but is exemplary. The drawing is a diagram of one embodiment of the present invention.

DESCRIPTION OF THE PREFERRED EMBODIMENTS

In its broadest aspect, the present invention involves the use of a crossflow fluidized bed, connecting a downflow reactor and an entrained bed, to control the solids circulation rate in the system.

Referring to the drawing, which is a schematic drawing of one embodiment of the present invention, sand and char from Crossflow Fluidizied Bed 10 pass through Fluidized Zone 21 into the bottom of Char Combustor 20, which is an entrained bed reactor. These solids move up into the jet of Lift Air 22 which entrains them and carries them sufficiently so that an expanded entrained bed exists in Combustion Zone 23 of Combustor 20. The density difference between Combustion Zone 23 and Fluidized Zone 21 causes solids to continue to flow from Fluidized Zone 21 into Combustion Zone 23.

The quantity of solids flowing through Combustor 20 is proportional to the flow of fluidizing gas through Crossflow Fluidized Bed 10.

Secondary combustion air is added, via Combustion Air Inlet 24, to the sand and char entering Combustion Zone 23 and the char is combusted to form combustion products. Combustion air may be added in stages along Char Combustor 20 in order to stage the combustion process to minimize $NO_x$ formation. The combustion of char in Combustor 20 heats the sand which supplies the heat required for the gasification reactions.

The heated sand and combustion products leave Char Combustor 20 and enter Combustor Cyclone 30, from which combustion products leave through Combustion Product Outlet 31 for heat recovery, and the sand enters Combustor Cyclone Seal Leg 32, then passes into Coal Gasifier 40, which is a downflow reactor. Due to the pressure difference between Cyclone 30 and Gasifier 40, the sand builds up to Combustor Cyclone Seal Level 33 in Seal Leg 32, forming an effective gas seal between Cyclone 30 and Gasifier 40.

The pressure difference combustor Cyclone 30 and Coal Gasifier 40 is maintained by Differential Pressure Controller 34 which monitors pressure in Gasifier 40 through First Pressure Tap 41 and that in Cyclone 30 through Second Pressure Tap 35. Controller 34 actuates Damper 51 located in Gasification Products Outlet 52 so as to maintain the pressure in Line 42, which connects Gasifier 40 and Gasifier Cyclone 50, above that in Combustor Cyclone 30.

Coal Gasifier 40 may have internals, such as screen cylinders, Raschig rings, baffle plates, etc. Packing 43 is held in place by Packing Supports 44 and 45. The heated sand passes down through Gasifier 40, providing heat for endothermic reactions occurring in Gasifier 40, then the sand passes below Packing Support 45 into Gasifier Seal Leg 46, and then into Crossflow Fluidized Bed 10.

Located in Gasifier Seal Leg 46 are Steam and Coal Feed Nozzles 47. These nozzles are located below the packing so that the steam coal mixture issuing from the nozzles will have sufficient residence time in the moving bed of sand to have heated the coal through its plastic stage, thus avoiding the possibility of coal agglomerating in the packed region or sticking to the packing. The feed nozzles have to be jacketed with coolant to prevent sticking of coal internally in the feed nozzles. The optimum position for the Feed Nozzles 47 can be determined by trial and error methods or estimated from heat transfer calculations. Through the correct positioning of the nozzles it should be possible to feed coking coals.

The coal/steam mixture issuing from Feed Nozzles 47 passes upward through Coal Gasifier 40, forming a fluidized bed. The Coal is first pyrolyzed, then gasified as it passes through Coal Gasifier 40. At high enough temperatures pyrolysis tars would also be cracked. The resulting char and other gasification products pass through Line 42 into Gasifier Cyclone 50.

Gasification products leave Gasifier Cyclone 50 via Gasification Products Outlet 52, passing Damper 51. Char passes into Gasifier Cyclone Seal Leg 53, forming Gasifier Cyclone Seal Level 54, then the char flows out of Seal Leg 53 into Crossflow Fluidized Bed 10. Seal leg 53 prevents the flow of gas between Cyclone 50 and Crossflow Fluidized Bed 10. Variable Speed Char Auger 55 is used to recycle some of the char to Coal Gasifier 40.

Crossflow Fluidized Bed 10 is fluidized by gas entering from Fluidizing Gas Inlet 12, passing through Plenum 13 into Gas Distributor 14. Generally, the amount of fluidizing gas flowing into Crossflow Fluidized Bed 10 determines the solids circulation rate of the complete system. The fluidizing gas would be recycled products of combustion, $N_2$, or air. The fluidizing gas expands the Crossflow Fluidized Bed 10, passing through Free Board Area 15 over Baffle 11, into Combustion Zone 23 of Char Combustor 20. Baffle 11 serves to isolate what is happening at the fluidized zone 21 from what is happening in the rest of Crossflow Fluidized Bed 10.

Because solids are being removed from Crossflow Fluidized Bed 10 by means of the Lift Air 22 in Char Combustor 20, char from Gasifier Cyclone Seal Leg 53 and sand from Gasifier Seal Leg 46 move across Crossflow Fluidized Bed 10 into Char Combustor 20. Generally, the Crossflow Fluidized Bed 10 cross-sectional area would be only large enough to accommodate the positioning of Gasifier Seal Leg 46, Gasifier Cyclone Seal Leg 53, Char Combustor 20 and Baffle 11. If cooling were required for the process Crossflow Fluidized Bed 10 would be expanded to include heat transfer surface.

This invention can be used for the gasification pyrolyzing or retorting of solid fuels or any process which is divided into an endothermic section and an exothermic section. The endothermic reactions occur in a reactor which has a downward moving bed of solids. The endothermic reactor can be either fluidized or not fluidized. Also, the endothermic reactor can either have internals or not have internals.

A chief advantage of this invention is that it provides a means of smoothly controlling the circulation of solids between two reactors and a means of sealing and maintaining separate the gaseous products from the two reactors. This is accomplished without mechanical valves.

It would be advantageous to recycle a portion of the char to the gasifier. This would be done because it is impossible to design the gasifier to always gasify the correct amount of char for various feed stocks. The recycle allows only the char needed to heat the sand heat carrier to enter the fluidized bed. If the auger allowed too much gas bypassing, the char might have to be removed from the gasifier cyclone seal leg and reintroduced into the gasifier through a lock hopper. The amount of char allowed into the combustor would be controlled by the outlet temperature of the char combustor.

Another reason for recycling char is that it allows a shorter gasifier since less residence time is required if the char can make several passes through the gasifier.

It would also be possible to use the connecting fluidized bed as the main char combustor taking advantage of the long solids residence time. The char combustor would act more as an afterburner for control of $NO_x$ by operating the fluidized bed fuel rich and staging the entrained bed.

Although the above embodiment deals with the gasification of coal, this process can be used for the gasification of other carbonaceous materials such as organic char and coke products. Also, catalysts can be incorporated into the coal to catalyze the gasification reaction. The use of such catalysts as alkali metal compounds are well known in the art. Also, sulfur getters, such as compounds of alkaline earth metals, can also be incorporated into the coal in this process to remove any sulfur generated by the process.

While the present invention has been described with reference to specific embodiments, this application is intended to cover those various changes and substitutions which may be made by those skilled in the art without departing from the spirit and scope of the appended claims.

What is claimed is:

1. A method of controlling the solids circulation between a downflow coal gasification reactor and an entrained bed combustion reactor comprising:

(a) transferring at least some of said solids from said downflow reactor to a crossflow fluidized bed through at least one seal leg, wherein said crossflow fluidized bed has a baffle separating the crossflow fluidized bed into two zones, wherein said two zones comprise a first zone and a second zone, and wherein said solids are transferred from said downflow reactor to the first zone of said crossflow fluidized bed;

(b) transferring said solids over said baffle from said first zone to said second zone;

(c) transferring said solids from said second zone of said crossflow fluidized bed to said entrained bed reactor; and (d) transferring said solids from said entrained bed reactor to said downflow reactor through a second seal leg; controlling the solids circulation rate by adjusting the rate of fluidizing gas entering said crossflow fluidized bed.

2. A method of controlling the solids circulation between a downflow reactor and an entrained bed reactor according to claim 1 wherein said solids comprises sand and char.

3. A method of controlling the solids circulation between a downflow reactor and an entrained bed reactor according to claim 2 wherein coal is gasified in said downflow reactor to form char and gasification products.

4. A method of controlling the solids circulation between a downflow reactor and an entrained bed reactor according to claim 3 wherein said downflow reactor contains internals.

5. A method of controlling the solids circulation between a downflow reactor and an entrained bed reactor according to claim 3 wherein said char and gasification products pass from said downflow reactor to a first cyclone which separates the gasification products from the char, and wherein a portion of said char flows through a third seal leg into the first zone of said crossflow fluidized bed.

6. A method of controlling the solids circulation between a downflow reactor and an entrained bed reactor according to claim 5 wherein some of said char is recycled from said first cyclone to said downflow reactor.

7. A method of controlling the solids circulation between a downflow reactor and an entrained bed reactor according to claim 3 wherein said char is combusted with air in said entrained bed reactor to form combustion products.

8. A method of controlling the solids circulation between a downflow reactor and an entrained bed reactor according to claim 7 wherein said air is added to said entrained bed reactor in stages.

9. A method of controlling the solids circulation between a downflow reactor and an entrained bed reactor according to claim 7 wherein said combustion products are separated from said sand by a second cyclone, and wherein said second seal leg connects said second cyclone to said downflow reactor.

10. A method of controlling the solids circulation between a downflow reactor and an entrained bed reactor according to claim 9 wherein the pressure difference between said second cyclone and said downflow reactor is maintained by a differential pressure controller.

11. A method of controlling the solids circulation between a downflow reactor and an entrained bed reactor comprising:

(a) gasifying coal in said downflow reactor to form char and gasification products, wherein said downflow reactor contains internals;

(b) transferring said fron said downflow reactor to a crossflow fluidized bed through a downflow reactor seal leg, wherein said downflow reactor seal leg connects said downflow reactor and said crossflow fluidized bed, wherein said crossflow fluidized bed has a baffle separating the crossflow fluidized bed into two zones, wherein said two zones comprise a first zone and a second zone, and wherein said sand is transferred from said downflow reactor to the first zone of said crossflow fluidized bed;

(c) passing said char and gasification products from said downflow reactor to a first cyclone which separates the gasification products from the char, and wherein a portion of said char flows through a first cyclone seal leg into said first zone of said crossflow fluidized bed;

(d) recycling some of said char from said first cyclone to said downflow reactor;

(e) transferring said sand and char over said baffle from said first zone to said second zone;

(f) transferring said sand and char from said second zone of said crossflow fluidized bed to said entrained bed reactor;

(g) combusting said char with air in said entrained bed reactor to form combustion products, wherein said air is added to said entrained bed reactor in stages;

(h) separating said combustion products from said said by a second cyclone, wherein a second cyclone seal leg connects said second cyclone to said downflow reactor, and wherein the pressure difference between said second cyclone and said downflow reactor is maintained by a differential pressure controller; and (i) transferring said sand from said entrained bed reactor to said downflow reactor through said second cyclone seal leg; and controlling the solids circulation rate by adjusting the rate of fluidizing gas entering said crossflow fluidized bed.

12. A method for the gasification of coal comprising:

(a) introducing sand into an upper portion of a vertically elongated downflow reactor containing internals, the downflow reactor having a means for substantially impeding vertical backmixing of vertically moving solids in the downflow reactor;

(b) introducing a coal into a lower portion of said downflow reactor, the physical characteristics of the sand and the coal differing such that a superficial velocity of a fluid flowing upwardly through the downflow reactor is greater than the minimum fluidizing velocity of the sand and the terminal velocity of the coal, but is less than the terminal velocity of the sand;

(c) passing steam upwardly through said downflow reactor at a rate sufficient to fluidize the sand and entrain the coal to maintain substantially countercurrent vertical flow of the sand and coal in the downflow reactor without substantial top-to-bottom backmixing of the sand and the coal in the downflow reactor, whereby the sand substantially flows downwardly in a fluidized state through the downflow reactor and the coal substantially flows upwardly in an entrained state through the downflow reactor, whereby the steam reacts with the coal to form a hot char and a gaseous product;

(d) removing the same from a lower end of said downflow reactor at a temperature substantially lower than the temperature at which the sand was introduced into the downflow reactor;

(e) transferring sand from said downflow reactor to a crossflow fluidized bed through a downflow reactor seal leg, wherein said downflow reactor seal leg connects said downflow reactor and said crossflow fluidized bed, wherein said cross-flow fluidized bed has a baffle separating the crossflow fluidized bed into two zones, wherein said two zones comprise a first zone and a second zone, and wherein said sand is transferred from said downflow reactor to the first zone of said crossflow fluidized bed;

(f) passing said char and gasification products from said downflow reactor to a first cyclone which separates the gasification products from the char, and wherein a portion of said char flows through a first cyclone seal leg into said first zone of said crossflow fluidized bed;

(g) recycling some of said char from said first cyclone to said downflow reactor;

(h) transferring said sand and char over said baffle from said first zone to said second zone;

(i) transferring at least a portion of the sand and char from said second zone of said crossflow fluidized bed to a vertically elongated entrained bed reactor;

(j) heating the sand to an elevated temperature in said entrained bed reactor by contacting the sand and hot char with air at a rate sufficient to entrain the sand and char mixture and combust the char, wherein said air is added to said entrained bed reactor in stages;

(k) separating said combustion product from said sand and char by a second cyclone, wherein a second cyclone seal leg connects said second cyclone to said downflow reactor, and wherein the pressure difference between said second cyclone and said downflow reactor is maintained by a differential pressure controller; and (l) transferring said sand from said entrained bed reactor to said downflow reactor through said second cyclone seal leg; and controlling the solids circulation rate by adjusting the rate of fluidizing gas entering said crossflow fluidized bed.

* * * * *

UNITED STATES PATENT AND TRADEMARK OFFICE

CERTIFICATE OF CORRECTION

PATENT NO. : 4,519,810

DATED : May 28, 1985

INVENTOR(S) : JOHN C. HAAS

It is certified that error appears in the above-identified patent and that said Letters Patent are hereby corrected as shown below:

Col. 6, line 46, "transferring said from said" should read --transferring sand from said--

Col. 7, line 6, "from said said by a" should read --from said sand by a--

Col. 7, line 44, "removing the same from" should read --removing the sand from--

Signed and Sealed this

*Twenty-ninth* Day of *October 1985*

[SEAL]

*Attest:*

DONALD J. QUIGG

*Attesting Officer*

*Commissioner of Patents and Trademarks—Designate*